US010865696B2

(12) United States Patent
Murai et al.

(10) Patent No.: US 10,865,696 B2
(45) Date of Patent: Dec. 15, 2020

(54) COOLING DEVICE FOR INTERNAL COMBUSTION ENGINE OF VEHICLE AND CONTROL METHOD THEREOF

(71) Applicant: Hitachi Automotive Systems, Ltd., Hitachinaka (JP)

(72) Inventors: Atsushi Murai, Isesaki (JP); Shigeyuki Sakaguchi, Isesaki (JP); Yuichi Toyama, Isesaki (JP)

(73) Assignee: Hitachi Automotive Systems, Ltd., Hitachinaka (JP)

( * ) Notice: Subject to any disclaimer, the term of this patent is extended or adjusted under 35 U.S.C. 154(b) by 0 days.

(21) Appl. No.: 15/760,790

(22) PCT Filed: Jun. 14, 2017

(86) PCT No.: PCT/JP2017/021988
§ 371 (c)(1),
(2) Date: Mar. 16, 2018

(87) PCT Pub. No.: WO2017/217462
PCT Pub. Date: Dec. 21, 2017

(65) Prior Publication Data

US 2018/0245504 A1 Aug. 30, 2018

(30) Foreign Application Priority Data

Jun. 16, 2016 (JP) ..... 2016-119755

(51) Int. Cl.
*F01P 7/16* (2006.01)
*F01P 3/00* (2006.01)
(Continued)

(52) U.S. Cl.
CPC ..... *F01P 7/164* (2013.01); *F01P 3/00* (2013.01); *F01P 3/02* (2013.01); *F01P 7/048* (2013.01);
(Continued)

(58) Field of Classification Search
CPC ..... F01P 3/00; F01P 3/02; F01P 3/20; F01P 7/16; F01P 7/164; F01P 7/167;
(Continued)

(56) References Cited

U.S. PATENT DOCUMENTS

2007/0175415 A1* 8/2007 Rizoulis ..... F01P 7/14 123/41.05
2012/0266828 A1* 10/2012 Araki ..... F01P 7/164 123/41.08
(Continued)

FOREIGN PATENT DOCUMENTS

JP 57210121 A * 12/1982 ..... F01P 7/164
JP 57210122 A * 12/1982 ..... F01P 7/164
(Continued)

OTHER PUBLICATIONS

Japanese-language Office Action issued in counterpart Japanese Application No. 2016-119755 dated Oct. 2, 2018 with partial English translation (five (5) pages).
(Continued)

*Primary Examiner* — John M Zaleskas
(74) *Attorney, Agent, or Firm* — Crowell & Moring LLP

(57) ABSTRACT

The cooling device according to the present invention includes an electric water pump for circulating cooling water through an internal combustion engine of a vehicle, and controls the discharge flow rate of the electric water pump as follows. Until the cooling water temperature. TW reaches a warm-up completion determination temperature, the cooling device increases the discharge flow rate along with an increase of the cooling water temperature TW. After the cooling water temperature TW reaches the warm-up completion determination temperature, the cooling device controls the discharge flow rate so as to bring the combustion chamber wall temperature TCYL toward a target temperature. Thereby, the cooling device can warm up the
(Continued)

internal combustion engine more efficiently, and improve the combustion performance of the internal combustion engine after the completion of warm-up.

5 Claims, 7 Drawing Sheets

(51) Int. Cl.
*F01P 7/04* (2006.01)
*F01P 3/02* (2006.01)
*F01P 7/14* (2006.01)
*F01P 5/10* (2006.01)

(52) U.S. Cl.
CPC ..... *F01P 7/167* (2013.01); *F01P 2003/001* (2013.01); *F01P 2003/027* (2013.01); *F01P 2005/105* (2013.01); *F01P 2007/146* (2013.01); *F01P 2025/30* (2013.01); *F01P 2025/40* (2013.01); *F01P 2025/66* (2013.01); *F01P 2060/08* (2013.01); *F01P 2060/16* (2013.01)

(58) Field of Classification Search
CPC ..... F01P 2025/30; F01P 2025/31; F01P 2025/32; F01P 2025/33; F01P 2025/50
USPC ..... 123/41.02, 41.05, 41.08
See application file for complete search history.

(56) References Cited

U.S. PATENT DOCUMENTS

2013/0190954 A1* 7/2013 Abihana ..... B60W 10/06 701/22
2014/0245975 A1* 9/2014 Quix ..... F01P 5/10 123/41.08
2014/0283764 A1* 9/2014 Abou-Nasr ..... F01P 7/162 123/41.02
2014/0360444 A1* 12/2014 Morita ..... F02D 35/025 123/41.08
2015/0007783 A1* 1/2015 Bilezikjian ..... F01P 3/02 123/41.02
2015/0377114 A1* 12/2015 Matsumoto ..... F02F 1/14 123/41.44
2016/0201548 A1* 7/2016 Moscherosch ..... F01P 7/162 123/41.02
2017/0002721 A1* 1/2017 Naik ..... F04B 49/02
2017/0096930 A1* 4/2017 Murai ..... F01P 3/02
2017/0107891 A1* 4/2017 Murai ..... F01P 3/02
2017/0254255 A1* 9/2017 Murai ..... F01P 3/20
2018/0245503 A1* 8/2018 Toyama ..... F01P 3/20
2018/0266304 A1* 9/2018 Toyama ..... F01P 7/04

FOREIGN PATENT DOCUMENTS

JP 57212323 A * 12/1982 ..... F01P 7/164
JP 3-47422 A 2/1991
JP 03047422 A * 2/1991
JP 4-17143 U 2/1992
JP 2005351173 A * 12/2005
JP 2006-324680 A 11/2006
JP 2007-24013 A 2/2007
JP 2009-103048 A 5/2009
JP 2012-193629 A 10/2012
JP 2012-197706 A 10/2012
JP 2012197706 A * 10/2012
JP 2013-44295 A 3/2013
JP 2013-53606 A 3/2013
JP 2015-178787 A 10/2015
JP 2015-178824 A 10/2015
WO WO 2014/192747 A1 12/2014
WO WO 2014192747 A1 * 12/2014 ..... F01P 7/167

OTHER PUBLICATIONS

Japanese-language International Search Report (PCT/ISA/210) issued in PCT Application No. PCT/JP2017/021988 with English translation dated Aug. 29, 2017 (four (4) pages).
Japanese-language Written Opinion (PCT/ISA/237) issued in PCT Application No. PCT/JP2017/021988 dated Aug. 29, 2017 (five (5) pages).
Japanese-language International Preliminary Report on Patentability (PCT/IPEA/409) issued in PCT Application No. PCT/JP2017/021988 with English translation dated Jan. 25, 2018 (five (5) pages).
Notification of Transmittal of Translation of the International Preliminary Report on Patentability (PCT/IB/338) issued in PCT Application No. PCT/JP2017/021988 dated Dec. 20, 2018, including English translation of document C3 (Japanese-language International Preliminary Report on Patentability (PCT/IPEA/409) previously filed on Mar. 16, 2018)) (six (6) pages).
German-language Office Action issued in counterpart German Application No. DE 112017003025.0 dated Mar. 21, 2019 with English translation (12 pages).

* cited by examiner

COOLING DEVICE FOR INTERNAL COMBUSTION ENGINE OF VEHICLE AND CONTROL METHOD THEREOF

TECHNICAL FIELD

The present invention relates to a cooling device for an internal combustion engine of a vehicle and to a method for controlling the cooling device, and specifically relates to flow rate control of an electric water pump for circulating cooling water through the internal combustion engine of the vehicle.

BACKGROUND ART

Patent Document 1 discloses a cooling device for an internal combustion engine including a means for measuring or estimating an combustion chamber wall temperature, a means for identifying an operational state of an internal combustion engine, a means for determining a flow rate of cooling water based on the operational state, a means for determining a target combustion chamber wall temperature based on the operational state, and a means for correcting the flow rate of the cooling water such that a difference between the actual combustion chamber wall temperature and the target combustion chamber wall temperature is equal to or below a first predetermined value.

REFERENCE DOCUMENT LIST

Patent Document

Patent Document 1 JP 2006-342680 A

SUMMARY OF THE INVENTION

Problem to be Solved by the Invention

After the internal combustion engine is started from a cold state, the combustion chamber wall temperature quickly increases and reaches a constant temperature (engine warm-up completion temperature). In contrast, the temperature rise of the cooling water for the internal combustion engine is less responsive, and reaches the engine warm-up completion temperature later than the combustion chamber wall temperature does. Thus, if the flow rate of the electric water pump for circulating the cooling water through the internal combustion engine of the vehicle is controlled based on the combustion chamber wall temperature as early as the cold engine start, the flow rate is controlled to meet the cooling water demand for after the completion of engine warm-up before the cooling water temperature actually reaches the engine warm-up completion temperature. This slows down the temperature rise of the cooling water (slows down the overall warm-up completion of the internal combustion engine).

In light of this, an object of the present invention is to provide a cooling device for an internal combustion engine of a vehicle and a method for controlling the cooling device. The cooling device and method can warm up the internal combustion engine more efficiently, and improve the combustion performance of the internal combustion engine after the completion of warm-up.

Means for Solving the Problem

To this end, a cooling device for an internal combustion engine of a vehicle according to an aspect of the present invention comprises: an electric water pump for circulating cooling water through the internal combustion engine of the vehicle; and pump control means for controlling a discharge flow rate of the electric water pump, wherein the pump control means controls the discharge flow rate of the electric water pump according to a temperature of the cooling water when the temperature of the cooling water is below a warm-up completion determination temperature, and the pump control means controls the discharge flow rate of the electric water pump according to a combustion chamber wall temperature of the internal combustion engine when the temperature of the cooling water is above the warm-up completion determination temperature.

A method for controlling a cooling device for an internal combustion engine of a vehicle according to an aspect of the present invention is applied to the cooling device including an electric water pump for circulating cooling water through the internal combustion engine of the vehicle, and the control method comprises the steps of: comparing a temperature of the cooling water with a warm-up completion determination temperature; controlling a discharge flow rate of the electric water pump according to the temperature of the cooling water when the temperature of the cooling water is below the warm-up completion determination temperature; and controlling the discharge flow rate of the electric water pump according to a combustion chamber wall temperature of the internal combustion engine when the temperature of the cooling water is above the warm-up completion determination temperature.

Effects of the Invention

The cooling device and method according to the present invention can prevent the slowing down of the overall warm up of the internal combustion engine, and improve the combustion performance of the internal combustion engine after the completion of warm-up.

MODE FOR CARRYING OUT THE INVENTION

Figure 1:
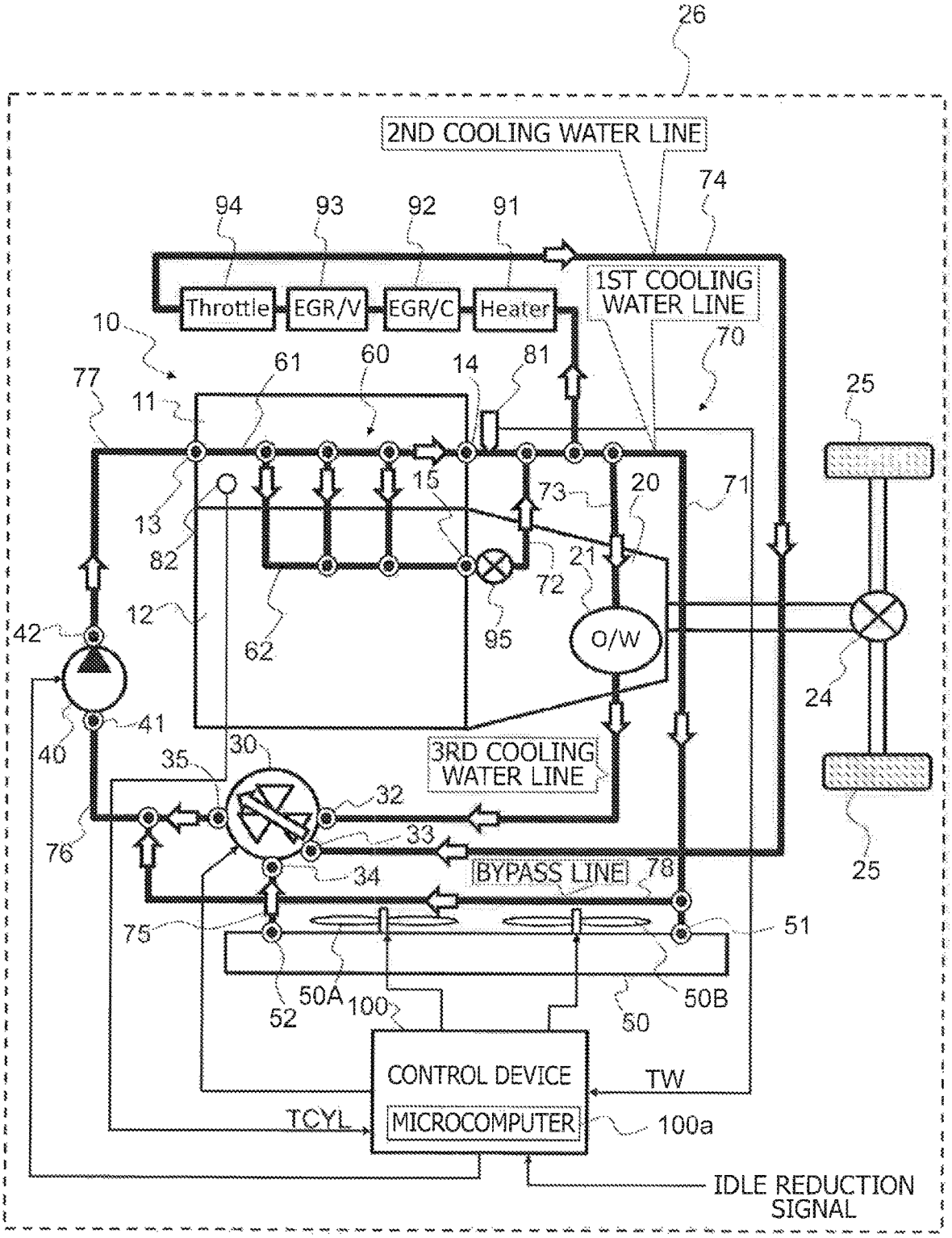
FIG. 1 is a schematic system view of the cooling device for an internal combustion engine according to an embodiment of the present invention.

An embodiment of the present invention will be described below. FIG. 1 is a configuration diagram illustrating an implementation of a cooling device for the internal combustion engine of the vehicle. The term "cooling water" herein encompasses various coolants used in water-based cooling devices for an internal combustion engine of a vehicle, such as Engine antifreeze coolants standardized under Japanese Industrial Standard K 2234.

An internal combustion engine 10 is installed in a vehicle 26 and used as a power source to drive vehicle 26. A transmission 20 such as a continuously variable transmission (CVT), an example of the powertrain, is coupled to the output shaft of internal combustion engine 10. The output of transmission 20 is transmitted to drive wheels 25 of vehicle 26 via a differential gear 24.

Internal combustion engine 10 is cooled by a water-based cooling device which circulates cooling water through circulation paths. The cooling device includes a flow rate control valve 30, an electric water pump 40, a radiator 50 including electric radiator fans 50A, 50B, a cooling water passage 60 provided in internal combustion engine 10, a heater core 91, an oil warmer and cooler 21 for transmission 20, pipes 70 connecting these components, and the like.

Internal combustion engine 10 has a cylinder head cooling water passage 61 and a cylinder block cooling water passage 62, which collectively serve as cooling water passage 60 in internal combustion engine 10. Cylinder head cooling water passage 61, which functions to cool a cylinder head 11, extends in cylinder head 11 so as to connect a cooling water inlet 13 to a cooling water outlet 14 which are provided to cylinder head 11. In cylinder head 11, cooling water inlet 13 is provided at one end in the cylinder arrangement direction, and cooling water outlet 14 is provided at the other end in the cylinder arrangement direction.

Cylinder block cooling water passage 62, which functions to cool a cylinder block 12, branches off from cylinder head cooling water passage 61 and enters cylinder block 12, Cylinder block cooling water passage 62 extends in cylinder block 12 and is connected to a cooling water outlet 15 provided to cylinder block 12. Cooling water outlet 15 of cylinder block cooling water passage 62 is provided at an end, on the same side where cooling water outlet 14 of cylinder head cooling water passage 61 is provided, in the cylinder arrangement direction.

In this cooling device illustrated in FIG. 1, the cooling water is supplied through cylinder head 11 to cylinder block 12. The cooling water supplied to cylinder head 11 is split into two paths of: a circulation path through which the cooling water flows bypassing cylinder block 12 (cylinder block cooling water passage 62) and is discharged from cooling water outlet 14; and a circulation path through which the cooling water enters cylinder block. 12 (cylinder block cooling water passage 62) and is then discharged from cooling water outlet 15. To cooling water outlet 14 of cylinder head 11, one end of a first cooling water pipe 71 is connected. The other end of first cooling water pipe 71 is connected to a cooling water inlet 51 of radiator 50.

To cooling water outlet 15 of cylinder block cooling water passage 62, a thermostat 95 is disposed. Thermostat 95 opens or closes in response to the cooling water temperature. One end of a second cooling water pipe 72 is connected to the outlet of thermostat 95. The other end of second cooling water pipe 72 is connected to a certain point of first cooling water pipe 71. At the junction of first and second cooling water pipes 71, 72, the cooling water having passed through cylinder block 12 joins the cooling water having passed through cylinder head 11.

One end of a third cooling water pipe 73 is connected to first cooling water pipe 71 at a point downstream to the junction of first and second cooling water pipes 71, 72. The other end of third cooling water pipe 73 is connected to a first inlet port 32 of flow rate control valve 30. At a certain point of third cooling water pipe 73, oil warmer and cooler 21 is disposed as a heat exchanger for adjusting the temperature of hydraulic oil (automatic transmission fluid: ATF) in transmission 20, which is a hydraulic mechanism. Oil warmer and cooler 21 exchanges heat between the cooling water flowing through third cooling water pipe 73 and the hydraulic oil in transmission 20. In other words, third cooling water pipe 73 allows the cooling water having increased in temperature while flowing through internal combustion engine 10 to be partially diverted and introduced into oil warmer and cooler 21. Oil warmer and cooler 21 accelerates the temperature rise in the hydraulic oil in transmission 20 during cold engine start, and then controls the hydraulic oil temperature in transmission 20 so as to avoid an excessive rise in the oil temperature.

One end of a fourth cooling water pipe 74 is connected to first cooling water pipe 71 at a point between the junction of first and second cooling water pipes 71, 72 and the branch point from first cooling water pipe 71 to third cooling water pipe 73. The other end of fourth cooling water pipe 74 is connected to a second inlet port 33 of flow rate control valve 30. Various heat exchanging devices are disposed on fourth cooling water pipe 74, The heat exchanging devices disposed on fourth cooling water pipe 74 are, in the order from upstream to downstream, heater core 91 for vehicle air heating, a water-based EGR (exhaust gas recirculation) cooler 92, an EGR control valve 93, and a throttle valve 94. EGR cooler 92 and EGR control valve 93 constitute an EGR device of internal combustion engine 10. Throttle valve 94 regulates the rate of air intake into internal combustion engine 10.

Heater core 91, which is a heat exchanger for heating air for air-conditioning (for air heating) included in a vehicle air conditioner (vehicle air heater), exchanges heat between the cooling water flowing through fourth cooling water pipe 74 and the air for air-conditioning so as to heat the air for air-conditioning. EGR cooler 92, which is a heat exchanger for cooling recirculated exhaust, exchanges heat between the cooling water flowing through fourth cooling water pipe 74 and the exhaust recirculated into the intake system of internal combustion engine 10 by the EGR device so as to lower the temperature of the exhaust recirculated into the intake system of internal combustion engine 10.

EGR control valve 93 for regulating the exhaust recirculation rate and throttle valve 94 for regulating the rate of air intake into internal combustion engine 10 are heated by exchanging heat with the cooling water flowing through fourth cooling water pipe 74. Heating EGR control valve 93 and throttle valve 94 with the cooling water prevents the freezing of moisture in the exhaust around EGR control valve 93 as well as moisture in the intake air around throttle valve 94.

As described above, the cooling device of FIG. 1 allows the cooling water having passed through internal combustion engine 10 to be partially diverted and introduced into heater core 91, EGR cooler 92, EGR control valve 93, and throttle valve 94 so as to exchange heat therewith. One end of a fifth cooling water pipe 75 is connected to a cooling water outlet 52 of radiator 50. The other end of fifth cooling water pipe 75 is connected to a third inlet port 34 of flow rate control valve 30.

Flow rate control valve 30 has a single outlet port 35. One end of a sixth cooling water pipe 76 is connected to outlet port 35. The other end of sixth cooling water pipe 76 is connected to an intake port 41 of electric water pump 40. One end of a seventh cooling water pipe 77 is connected to a discharge port 42 of electric water pump 40. The other end of seventh cooling water pipe 77 is connected to cooling water inlet 13 of cylinder head 11.

One end of an eighth cooling water pipe 78 (radiator-bypass pipe) is connected to first cooling water pipe 71. Specifically, in first cooling water pipe 71, the point where eighth cooling water pipe 78 is connected is located downstream to the point connected to third cooling water pipe 73 and downstream to the point connected to fourth cooling water pipe 74. The other end of eighth cooling water pipe 78 is connected to sixth cooling water pipe 76 at a point upstream to intake port 41 of electric water pump 40 and downstream to the outlet of flow rate control valve 30. As described above, flow rate control valve 30 has three inlet ports 32 to 34 and one outlet port 35. Cooling water pipes 73, 74, 75 are respectively connected to inlet ports 32, 33, 34, and sixth cooling water pipe 76 is connected to outlet port 35.

For example, flow rate control valve 30 is a rotational flow channel switching valve that includes a stator having ports formed therein, and a rotor which has flow channels formed therein and is fitted in the stator. When flow rate control valve 30 is actuated by the electric actuator such as an electric motor, the electric actuator rotates the rotor, thereby changing the angle of the rotor relative to the stator. In rotational flow rate control valve 30 as described above, the opening area ratio of three inlet ports 32 to 34 changes depending on the rotor angle. The ports in the stator and the flow channels in the rotor are adapted such that a desirable opening area ratio, in other words, a desirable flow rate ratio among the cooling water lines may be achieved through selection of the rotor angle.

In the cooling device with the above configuration, cylinder head cooling water passage 61 (and cylinder block cooling water passage 62), first cooling water pipe 71, radiator 50, and fifth cooling water pipe 75 constitute a first cooling water line (radiator line) through which the cooling water circulates by way of internal combustion engine 10 and radiator 50.

Cylinder head cooling water passage 61 (and cylinder block cooling water passage 62), fourth cooling water pipe 74, heater core 91, EGR cooler 92, EGR control valve 93, and throttle valve 94 constitute a second cooling water line (heater line) through which the cooling water circulates by way of internal combustion engine 10 and heater core 91, and bypasses radiator 50. Cylinder head cooling water passage 61 (and cylinder block cooling water passage 62), third cooling water pipe 73, and oil warmer and cooler 21 constitute a third cooling water line (powertrain system line or CVT line) through which the cooling water circulates by way of internal combustion engine 10 and oil warmer and cooler 21, and bypasses radiator 50.

In addition, eighth cooling water pipe 78 allows the cooling water flowing through the first cooling water line to be partially diverted to flow through eighth cooling water pipe 78. The diverted flow of cooling water bypasses radiator 50, and enters a point downstream to the outlet of flow rate control valve 30. In other words, even when all of inlet ports 32 to 34 of flow rate control valve 30 are closed, eighth cooling water pipe 78 allows the cooling water having passed through internal combustion engine 10 (cylinder head cooling water passage 61) to circulate bypassing radiator 50. In this way, eighth cooling water pipe 78 constitutes a bypass line. As described above, the cooling device according to this embodiment includes the first to third cooling water lines and the bypass line as cooling water circulation paths.

As described above, the inlet ports 34, 33, 32 of flow rate control valve 30 are connected to the outlets of the first, second, and third cooling water lines, and the outlet port 35 of flow rate control valve 30 is connected to intake port 41 of electric water pump 40.

Flow rate control valve 30 is a flow channel switching mechanism (allocation ratio regulating means) for controlling the supply rates of the cooling water respectively to the first to third cooling water lines, in other words, for controlling the cooling water allocation ratio between the first to third cooling water lines, by regulating the opening areas of the respective outlets of the first to fourth cooling water lines.

Electric water pump 40 includes a pump unit which is rotated by a motor to provide a pressurized cooling water flow. Electric water pump 40 and flow rate control valve 30 are controlled by a control device 100 which includes a microcomputer (processor) 100*a*, including a CPU, a ROM, a RAM, and the like. In other words, control device 100 has software-based functions to serve as a means for controlling electric water pump 40 (pump control means) and a means for controlling flow rate control valve 30 (allocation control means).

Control device 100 receives various information for cooling control such as operational conditions of internal combustion engine 10 and conditions of the cooling device. As sensors for measuring the various information, the cooling device includes a water temperature sensor 81, a combustion chamber wall temperature sensor 82, and the like. Water temperature sensor 81 measures the temperature of the cooling water in first cooling water pipe 71 near cooling water outlet 14, i.e., a cooling water temperature TW near the outlet of cylinder head 11 (cylinder head outlet water temperature). Combustion chamber wall temperature sensor 82 measures a combustion chamber wall temperature TCYL of internal combustion engine 10.

From an engine control device (pot illustrated in Figures) for controlling the fuel injection valve and ignition device of internal combustion engine 10, control device 100 receives engine operational conditions signals such as an idle reduction command signal indicating whether or not internal combustion engine 10 is in an idle reduction state, an engine rotation speed signal, and an engine load signal. The term "idle reduction" refers to a stopped state of internal combustion engine 10 while the vehicle is parking or standing or while the vehicle is waiting for a traffic light to change. The idle reduction is also referred to as "no idling".

When conditions for starting idle reduction are satisfied, the engine control device stops fuel injection by the fuel injection valves as well as ignition operation by the spark plugs and automatically stops internal combustion engine 10. Then, when conditions for restarting internal combustion engine 10 while internal combustion engine 10 is automatically stopped by the idle reduction control (conditions for cancelling idle reduction) are satisfied, the engine control device resumes the fuel injection and ignition operation and restarts internal combustion engine 10. Combustion chamber wall temperature sensor 82 may be integrally provided to the spark plug. As an alternative, when internal combustion engine 10 is an in-cylinder direct injection type, combustion chamber wall temperature sensor 82 may be integrally provided to the fuel injection valve. As another alternative, combustion chamber wall temperature sensor 82 may be a separate unit provided to the combustion chamber wall of internal combustion engine 10.

When internal combustion engine 10 does not include combustion chamber wall temperature sensor 82, control device 100 may estimate (calculate) the combustion chamber wall temperature TCYL based on the operational conditions, such as the engine load and engine rotation speed, of internal combustion engine 10, the measurement value of lubricating oil temperature of internal combustion engine 10, the cooling water temperature TW, which is measured by water temperature sensor 81, and/or the like. Based on the cooling water temperature TW, the combustion chamber wall temperature TCYL, and other conditions such as whether or not it is during idle reduction, control device 100 controls the rotor angle of flow rate control valve 30 (flow rate allocation), the rotation speed (discharge flow rate) of electric water pump 40, the driving voltage of electric radiator fans 50A, 50B, and the like.

Figure 2:
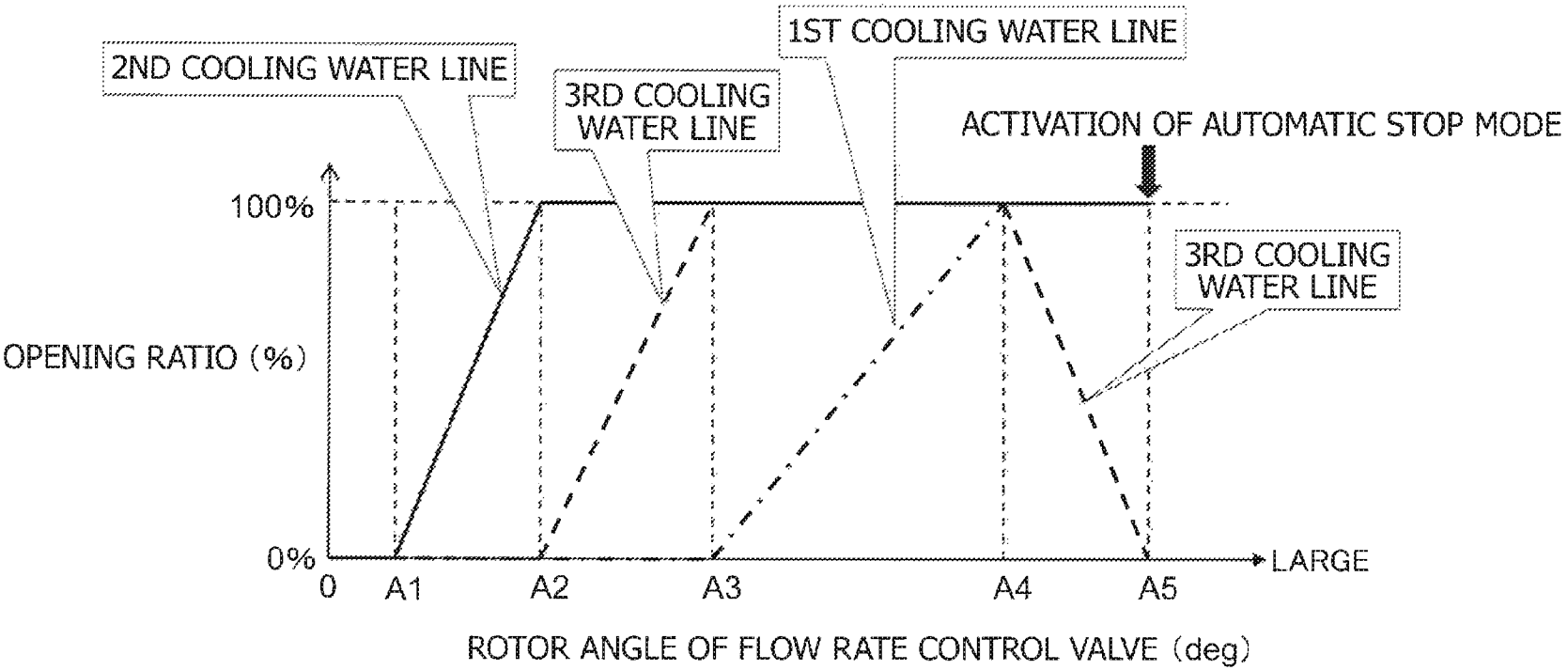
FIG. 2 is a graph illustrating the correlation between the rotor angle and modes of the flow rate control valve according to the embodiment of the present invention.

FIG. 2 illustrates an illustrative example of the correlation between the rotor angle of flow rate control valve 30 and the opening ratio (%) of each of inlet ports 32 to 34 in the system configuration of FIG. 1, The term "opening ratio" herein refers to the ratio of the actual opening area to the full opening area of each of inlet ports 32 to 34, The term "rotor angle" (degrees) herein refers to the angular change amount from the initial position (default position) of the rotor of flow rate control valve 30, i.e., the position where the rotor is contact with a stopper, given that the rotor angle when the rotor is at the initial position is 0 degrees When the rotor angle of flow rate control valve 30 is equal to or below a first rotor angle A1 (A1>0), i.e., within the angular range from the initial position (0 degrees) to the first rotor angle A1 (degrees), three inlet ports 32 to 34, which are connected to the first, second and third cooling water lines, are maintained fully closed (opening ratio=0%), In other words, the angular range from 0 degrees to the first rotor angle A1 (degrees) is a dead range within which all of inlet ports 32 to 34 are maintained fully closed. Note that, when the rotor angle of flow rate control valve 30 is equal to or below the first rotor angle A1 (A1>0), at least one of inlet ports 32 to 34 may allow a leak flow with a rate equal to or below a predetermined flow rate.

Then, as the rotor angle of flow rate control valve 30 exceeds and increases above the first rotor angle A1, the opening ratio (opening area) of inlet port 33, connected to the second cooling water line, gradually increases with inlet ports 32, 34, connected to the first and third cooling water lines, maintained fully closed. Inlet port 33 becomes fully opened (opening ratio=100%) when the rotor angle becomes a second rotor angle A2 (A2>A1>0).

As the rotor angle further increases from the angle A2, at which the opening ratio of inlet port 33 reaches the maximum, the opening ratio of inlet port 32, connected to the third cooling water line, gradually increases. Inlet port 32 becomes fully opened (opening ratio=100%) when the rotor angle becomes a third rotor angle A3 (A3>A2>A1>0). Thus, at the third rotor angle A3, inlet ports 32, 33 are both fully opened and inlet port 34 is maintained fully closed. In other words, inlet port 34 is maintained fully closed within the angular range of the rotor from 0 degrees to the third rotor angle A3.

As the rotor angle further increases above the third rotor angle A3, the opening ratio of inlet port 34, connected to the first cooling water line, gradually increases. Inlet port 34 becomes fully opened (opening ratio=100%) when the rotor angle reaches a fourth rotor angle A4. Thus, at the fourth rotor angle A4, all inlet ports 32 to 34 are fully opened. As the rotor angle further increases above the fourth rotor angle A4, the opening ratio of inlet port 32, connected to the third cooling water line, gradually decreases from the maximum (opening ratio=100%). Inlet port 32 becomes fully closed (opening ratio=0%) again when the rotor angle reaches a fifth rotor angle A5 (A5>A4>A3>A2>A1>0). Thus, at the fifth rotor angle A5, inlet port 32 is fully closed and inlet ports 33, 34 are maintained fully opened.

In the angular range of rotor above the fifth rotor angle A5 (from the fifth rotor angle A5 to the maximum rotor angle at which the rotor is positionally regulated by a stopper), inlet port 32 is maintained fully closed and inlet ports 33, 34 are maintained fully opened. In other words, according to the opening characteristics of flow rate control valve 30 exemplified in FIG. 2, inlet port 33 (second cooling water line or heater line) is maintained fully closed from the initial position to the first rotor angle A1, then increases its opening area along with an increase in the rotor angle from the first rotor angle A1 to the second rotor angle A2, and maintained fully opened from the second rotor angle A2 to the fifth rotor angle A5.

Inlet port 32 (third cooling water line or powertrain system line) is maintained fully closed from the first rotor angle A1 to the second rotor angle A2, then increases its opening area along with an increase in the rotor angle from the second rotor angle A2 to the third rotor angle A3, then is maintained fully opened from the third rotor angle A3 to the fourth rotor angle A4, then deceases its opening area along with an increase in the rotor angle from the fourth rotor angle A4 to the fifth rotor angle A5, and becomes fully closed again at the fifth rotor angle A5.

Inlet port 34 (first cooling water line or radiator line) is maintained fully closed from the first rotor angle A1 to the third rotor angle A3, then increases its opening area along with an increase in the rotor angle from the third rotor angle A3 to the fourth rotor angle A4, and is maintained fully opened from the fourth rotor angle A4 to the fifth rotor angle A5. Note that, although FIG. 2 illustrates that the minimum opening ratio is 0% and the maximum opening ratio is 100% for inlet ports 32 to 34, control device 100 may control the opening ratio of each inlet port of flow rate control valve 30 within the range of 0%<opening ratio<100%, 0%≤opening ratio<100% or 0%<opening ratio≤100%.

Figure 3:
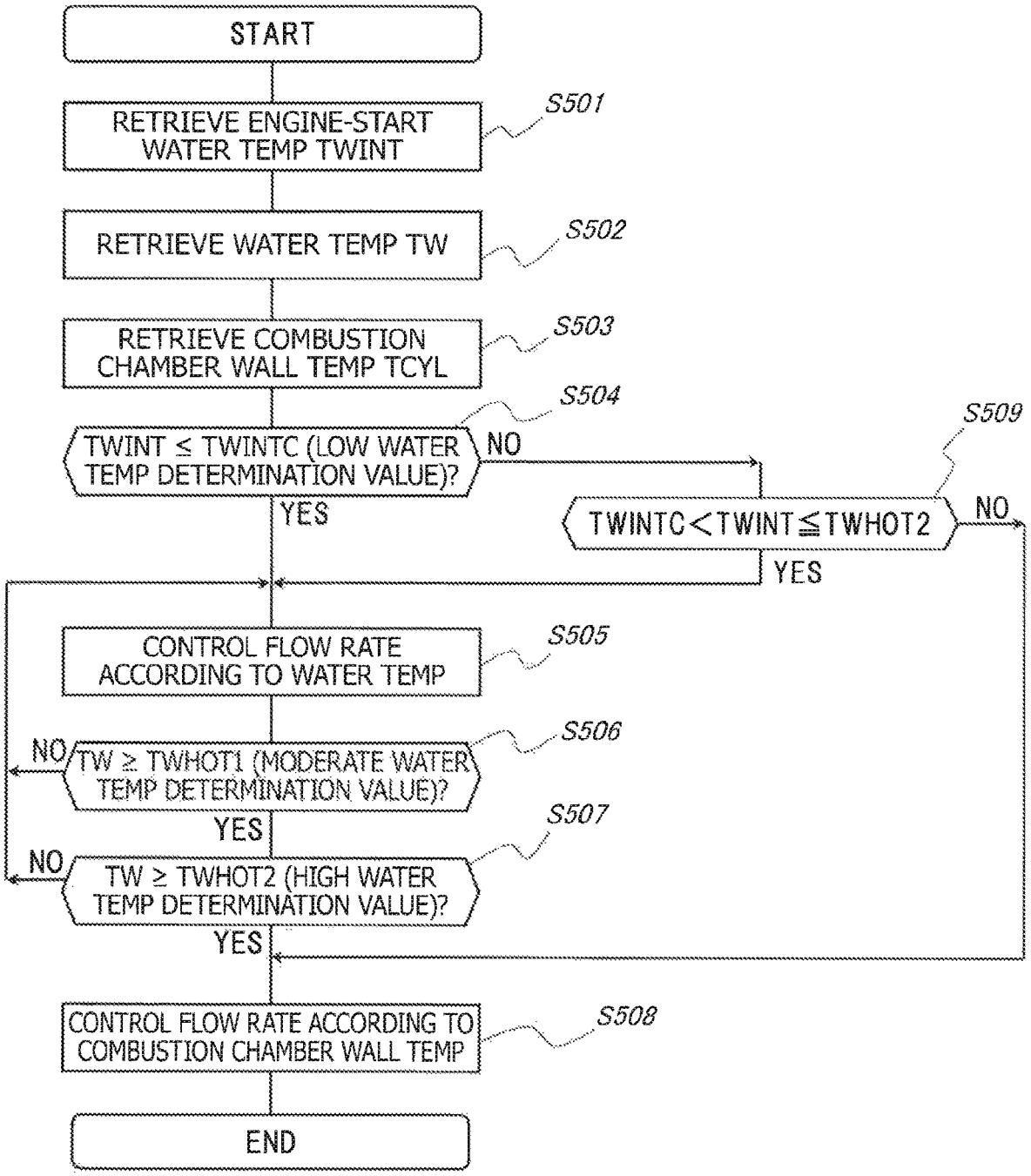
FIG. 3 is a flowchart illustrating the procedure of cooling control according to the embodiment of the present invention.

Next, with reference to the flowchart of FIG. 3, an implementation of the control performed by control device 100 will be described. Specifically, as illustrated in FIG. 3, control device 100 controls the discharge flow rate of electric water pump 40 and the rotor angle of flow rate control valve 30. The routine illustrated in the flowchart of FIG. 3 is interruptedly executed by control device 100 at predetermined time intervals.

First, in step S501, control device 100 retrieves an engine-start water temperature TWINT from memory. The engine-start water temperature TWINT is the cooling water temperature TW measured by water temperature sensor 81 when internal combustion engine 10 is started (when the engine switch is turned on). Control device 100 is configured to perform processing for acquiring the cooling water temperature TW output by water temperature sensor 81 when internal combustion engine 10 is started, and store the thus-acquired cooling water temperature TW to the memory as the engine-start water temperature TWINT. In step S501, control device 100 retrieves the thus-stored engine-start water temperature TWINT from the memory.

Then, the operation proceeds to step S502, in which control device 100 retrieves the latest value (current value) of the cooling water temperature TW output by water temperature sensor 81. Then, in step S503, control device 100 retrieves the latest value (current value) of the combustion chamber wall temperature TCYL, output by combustion chamber wall temperature sensor 82. After that, the operation proceeds to step S504, in which control device 100 compares the engine-start water temperature TWINT with a low water temperature determination value TWINTC (TWINTC=30° C. for example).

The low water temperature determination value TWINTC is a threshold value for determining whether or not internal combustion engine 10 is started from a cold state. The low water temperature determination value TWINTC is adapted through experiments, simulation and/or the like in advance, and stored as a control constant in memory included in microcomputer 100*a* of control device 100. When control device 100 determines that the engine-start water temperature TWINT is equal to or below the low water temperature determination value TWINTC; in other words, detects that internal combustion engine 10 has been started from a cold state (when the overall temperature of internal combustion engine 10 is approximately the external air temperature), the operation proceeds to step S505. In step S505, control device 100 performs cooling control adapted for the period from the engine cold state to the completion of engine warm-up (first control, or engine warm-up control according to the cooling water temperature TW).

The cooling control performed by control device 100 in step S505 is a cooling water temperature control for accelerating the increase of the cooling water temperature TW until the completion of engine warm-up. Specifically, the cooling control in step S505 includes the control of the rotation speed (discharge flow rate) of electric water pump 40 in accordance with the cooling water temperature TW and the control of the rotor angle of flow rate control valve 30 in accordance with the cooling water temperature TW. Furthermore, the cooling control in step S505 is divided broadly into control for low water temperature and control for moderate water temperature. The control for low water temperature is performed from the cold engine start until the cooling water temperature TW reaches a moderate water temperature determination value TWHOT1. The control for moderate water temperature is performed from when the cooling water temperature TW reaches the moderate water temperature determination value TWHOT1 until the cooling water temperature TW reaches a high water temperature determination value TWHOT2 (warm-up completion determination temperature).

First, as the control for low water temperature, control device 100 controls the discharge flow rate of electric water pump 40 at a predetermined minimum flow rate until the cooling water temperature TW increases to the moderate water temperature determination value TWHOT1, which is a threshold temperature for starting the heater operation. The moderate water temperature determination value TWHOT1 is set lower than the high water temperature determination value TWHOT2, which is the warm-up completion determination temperature. Specifically, the moderate and high water temperature determination values TWHOT1, TWHOT2 are set so as to satisfy TWINTC<TWHOT1<TWHOT2, and, for example, set to 60° C. and 80° C., respectively.

The minimum flow rate is set to a flow rate as low as possible within a range that can prevent or reduce variation in temperature within the cooling water circulation paths; in other words, set to a flow rate as low as possible within a range that allows the cooling water temperature TW output by water temperature sensor 81 accurately reflects the degree of overall warm-up progression of internal combustion engine 10. For example, the minimum flow rate is set to approximately 3 L/min. That is, at cold engine start, control device 100 controls the rotation speed of electric water pump 40 so as to minimize the discharge flow rate of electric water pump 40. Thereby, while internal combustion engine 10 is cold, control device 100 reduces the circulation flow rate of the cooling water as much as possible, and thus accelerates the increase of the cooling water temperature TW.

As the control for low water temperature, at the same time of controlling the discharge flow rate of electric water pump 40 at the predetermined minimum flow rate, control device 100 also controls the rotor angle of flow rate control valve 30 within a range not higher than the first rotor angle A1 so as to maintain three inlet ports 32 to 34, connected to the first to third cooling water lines, fully closed. From the cold engine start until the cooling water temperature TW increases to the moderate water temperature determination value TWHOT1, thermostat 95 is maintained closed.

As a result, while control device 100 performs the control for low water temperature, the minimum flow rate of cooling water discharged from electric water pump 40 circulates by flowing through the path which extends through cylinder head cooling water passage 61 and the bypass line, bypassing the heat exchangers such as heater core 91, oil warmer and cooler 21, and radiator 50, and then returning to electric water pump 40. In other words, by circulating the cooling water while bypassing the heat exchangers such as heater core 91, oil warmer and cooler 21, and radiator 50, control device 100 prevents the high-temperature cooling water that was heated while flowing through cylinder head cooling water passage 61 from decreasing in temperature (releasing its heat) while flowing back to electric water pump 40. In this way, through the control for low water temperature, control device 100 accelerates the increase of the cooling water temperature TW.

When the increase of the cooling water temperature TW is accelerated, the heater core 91 can start heating the air for air conditioning earlier. This allows for a quicker rise of the air heating temperature at engine start as well as earlier enhancement of the fuel vaporization performance, thus improving fuel economy and exhaust properties. After control device 100 starts the control for low water temperature in step S505, the operation proceeds to step S506. In step S506, control device 100 determines whether or not the cooling water temperature TW has increased to equal to or above the moderate water temperature determination value TWHOT1.

When control device 100 determines that the cooling water temperature TW is below the moderate water temperature determination value TWHOT1, the operation returns to step S505. Thereby, control device 100 continues to control the rotor angle of flow rate control valve 30 within the range not higher than the first rotor angle A1, while controlling the discharge flow rate of electric water pump 40 at the minimum flow rate (continues to perform the control for low water temperature). On the other hand, when control device 100 determines that the cooling water temperature TW is equal to or above the moderate water temperature determination value TWHOT1, the operation proceeds from step S506 to step S507. In step S507, control device 100 determines whether or not the cooling water temperature TW is equal to or above the high water temperature determination value TWHOT2, which is the warm-up completion determination temperature.

When control device 100 determines that the cooling water temperature TW is below the high water temperature determination value TWHOT2; in other words, the cooling water temperature TW is in the temperature range between the moderate and high water temperature determination values TWHOT1, TWHOT2, the operation returns to step S505. In step S505, control device 100 switches the control according to the cooling water temperature TW from the control for low water temperature to the control for moderate water temperature. As the control for moderate water temperature, control device 100 first increases the rotor angle of flow rate control valve 30 as the cooling water temperature TW increases above the moderate water temperature determination value TWHOT1. Thereby, control device 100 first opens the second cooling water line from among the first to third cooling water lines, all of which have been fully closed, so as to start cooling water circulation through heater core 91 and the like. Then, when the cooling water temperature TW further increases after the second cooling water line has opened, control device 100 additionally opens the third cooling water line to start cooling water circulation through oil warmer and cooler 21.

As the control for moderate water temperature, at the same time of controlling the flow rate control valve 30 in the above manner, control device 100 also controls and increases the discharge flow rate of electric water pump 40 along with an increase of the cooling water temperature TW. Specifically, at the same time of opening the second cooling water line and starting cooling water circulation through heater core 91, control device 100 increases the discharge flow rate of electric water pump 40 so as to meet the cooling water demand for circulating the required rate of cooling water through the second cooling water line. Furthermore, at the same time of opening the third cooling water line, control device 100 further increases the discharge flow rate of electric water pump 40 so as to meet the cooling water demand for circulating the required rate of cooling water through the second and third cooling water lines. In other words, control device 100 maintains the discharge flow rate of electric water pump 40 at the minimum flow rate while performing the control for low water temperature, and control device 100 increases the discharge flow rate of electric water pump 40 along with the increase of the cooling water temperature TW while performing the control for moderate water temperature.

While performing the control for moderate water temperature, control device 100 controls the discharge flow rate of electric water pump 40 within a range, for example, from 10 to 20 L/min in accordance with the cooling water temperature TW (in accordance with the opening ratios of the second and third cooling water lines). In other words, in step S505, control device 100 controls and increases the discharge flow rate of electric water pump 40 along with an increase of the cooling water temperature TW. Then, when, in step S507, control device 100 determines that the cooling water temperature TW is equal to or above the high water temperature determination value TWHOT2; in other words, determines that the warm-up of internal combustion engine 10 has completed, the operation proceeds to step S508. In step S508, control device 100 performs cooling control adapted for after the completion of engine warm-up (second control, or control according to the combustion chamber wall temperature TCYL).

On the other hand, when, in step S504, control device 100 determines that the engine-start water temperature TWINT is above the low water temperature determination value (cold start determination temperature) TWINTC; in other words, determines that internal combustion engine 10 is restarted before the cooling water temperature TW decreases to approximately the external air temperature, the operation proceeds to step S509. Specifically, when control device 100 detects that internal combustion engine 10 has been started from a non-cold state, control device 100 determines whether or not the engine-start water temperature TWINT is above the low water temperature determination value TWINTC and equal to or below the high water temperature determination value (warmup completion determination temperature) TWHOT2, in step S509.

When control device 100 determines that the engine-start water temperature TWINT satisfies TWINTC<TWINT≤TWHOT2, the operation proceeds to step S505. In step S505, control device 100 performs the cooling water temperature control (first control) for accelerating the increase of the cooling water temperature TW. Here, as described above, the cooling control in step S505 includes: the control for low water temperature, which is performed until the cooling water temperature TW reaches the moderate water temperature determination value TWHOT1; and the control for moderate water temperature, which is performed from when the cooling water temperature TW reaches the moderate water temperature determination value TWHOT1 until the cooling water temperature TW reaches the high water temperature determination value TWHOT2 (warm-up completion determination temperature). In other words, when TWINTC>TWINT≤TWHOT2 is satisfied, it is not considered that internal combustion engine 10 is in a state referred to as cold engine start but it is still desired to accelerate the increase of the cooling water temperature TW so as to quickly complete the engine warm-up operation. Accordingly, control device 100 controls the rotation speed (discharge flow rate) of electric water pump 40 in accordance with the cooling water temperature TW while controlling the rotor angle of flow rate control valve 30 in accordance with the cooling water temperature TW in the same manner as at cold engine start.

When the engine-start water temperature TWINT does not satisfy TWINTC<TWINT≤TWHOT2, but satisfies TWINT>TWHOT2 it is considered that internal combustion engine 10 is restarted after the completion of the warm-up. In such a case, the control for accelerating the increase of the cooling water temperature TW is not necessary. Thus, the operation proceeds to step S508, in which control device 100 performs the cooling control adapted for after the completion of engine warm-up. In step S508, as the cooling control adapted for after the completion of engine warm-up, control device 100 controls the rotation speed (discharge flow rate) of electric water pump 40 in accordance with the combustion chamber wall temperature TCYL while controlling the rotor angle of flow rate control valve 30 in accordance with the cooling water temperature TW.

In step S508, control device 100 controls flow rate control valve 30, i.e., controls the rotor angle of flow rate control valve 30 in accordance with the cooling water temperature TW. Specifically, as the cooling water temperature TW increases above a target temperature for after the completion of engine warm-up, control device 100 increases the opening degree of the first cooling water line with the second and third cooling water lines fully opened, Thereby, control device 100 increases the flow rate of cooling water circulating through radiator 50, thus reducing the cooling water temperature TW toward the target temperature. On the other hand, as the cooling water temperature TW decreases below the target temperature for after the completion of engine warm-up, control device 100 reduces the opening degree of the first cooling water line. Thereby, control device 100 reduces the flow rate of cooling water circulating through radiator 50, thus increasing the cooling water temperature TW toward the target temperature.

In step S508, control device 100 also controls the rotation speed (discharge flow rate) of electric water pump 40 so as to maintain the combustion chamber wall temperature TCYL at a proper temperature. Specifically, control device 100 controls the rotation speed (discharge flow rate) of electric water pump 40 so as to bring the combustion chamber wall temperature TCYL toward a target temperature. Here, control device 100 may set the target value of the combustion chamber wall temperature TCYL based on the cooling water temperature TW. Specifically, control device 100 may set the target value of the combustion chamber wall temperature TCYL to either a value equal to the cooling water temperature TW or the sum of the cooling water temperature TW and a predetermined value (predetermined value>0 or predetermined value<0). Control device 100 may control the discharge flow rate of electric water pump 40 so as to bring the combustion chamber wall temperature TCYL toward this target temperature.

In the configuration in which the ignition timing of internal combustion engine 10 is corrected according to the cooling water temperature TW, controlling the discharge flow rate of electric water pump 40 as described above provides the following advantages. Such a control allows the ignition timing to be corrected to a proper timing in accordance with the combustion chamber wall temperature TCYL, thus improving fuel economy of internal combustion engine 10 and drivability, and reducing emissions. Here, abnormal combustion occurs depending on the combustion chamber wall temperature TCYL. Accordingly, when ignition timing is controlled and corrected in accordance with the cooling water temperature TW correlated with the combustion chamber wall temperature TCYL, using this control method will provide an outcome equivalent to that would be provided by correcting the ignition timing according to the combustion chamber wall temperature TCYL. In contrast, if the cooling control with the combustion chamber wall temperature TCYL correlated with the cooling water temperature TW is not performed, the correlation between the combustion chamber wall temperature TCYL and the cooling water temperature TW is not ensured. As a result, the actual ignition timing correction according to the cooling water temperature TW significantly differs from the required ignition timing correction according to the actual combustion chamber wall temperature TCYL, which may lead to abnormal combustion, and/or deteriorate fuel economy and exhaust properties.

When internal combustion engine 10 is stopped by the idle reduction control while control device 100 performs the cooling control in step S508 after the completion of the warm-up of internal combustion engine 10, control device 100 controls the rotor angle of flow rate control valve 30 at the angle (A5), thereby fully closing the third cooling water line while maintaining the first and second cooling water lines fully opened. In other words, during idle reduction of internal combustion engine 10, control device 100 reduces the combustion chamber wall temperature TCYL (cylinder head temperature) by maintaining electric water pump 40 in an operating state so as to maintain cooling water circulation. Thereby, control device 100 prevents or reduces the occurrence of knocking while improving power performance when internal combustion engine 10 running is resumed and the vehicle is restarted.

Here, if the cooling water circulation rate through radiator 50, which has a high heat radiation efficiency (rate), is increased, the combustion chamber wall temperature TCYL can be reduced in a more responsive manner by the cooling water circulation. However, during idle reduction of internal combustion engine 10, it is also desired to reduce the deterioration of the air heating performance. Thus, during idle reduction of internal combustion engine 10 after its warm-up has been completed, control device 100 closes the third cooling water line, which bypasses radiator 50 and heater core 91, while fully opening the first cooling water line, i.e., the circulation path extending by way of radiator 50, as well as the second cooling water line, i.e., the circulation path extending by way of heater core 91. Thereby, control device 100 quickly reduces the combustion chamber wall temperature TCYL while maintaining the air heating performance during idle reduction.

During idle reduction of internal combustion engine 10 after its warm-up has been completed, control device 100 maintains electric water pump 40 in an operating state while controlling the rotation speed (discharge flow rate) of electric water pump 40 so as to bring the combustion chamber wall temperature TCYL toward its target temperature for during idle reduction. During idle reduction, internal combustion engine 10 is stopped operating by the idle reduction control, so that the combustion chamber wall temperature TCYL decreases in a relatively responsive manner. Meanwhile, the cooling water temperature TW decreases in a less responsive manner than the combustion chamber wall temperature TCYL.

Thus, controlling the discharge flow rate in accordance with the cooling water temperature TW during idle reduction does not ensure reducing the combustion chamber wall temperature TCYL in a responsive manner and preventing an excessive temperature drop. In contrast, controlling the discharge flow rate in accordance with the combustion chamber wall temperature TCYL, during idle reduction ensures reducing the combustion chamber wall temperature TCYL to a proper temperature quickly as possible while preventing an excessive temperature drop. Thus, controlling the discharge flow rate in accordance with the combustion chamber wall temperature TCYL allows internal combustion engine 10 to restart with the combustion chamber wall temperature TCYL adjusted to an optimum value. Furthermore, restarting internal combustion engine 10 with the combustion chamber wall temperature TCYL adjusted to an optimum value reduces the occurrence of knocking when the vehicle is restarted from the idle reduction state, and allows advancing ignition timing and improving power performance.

As described above, after the completion of engine warm-up, performing the cooling control (flow rate control) in accordance with the combustion chamber wall temperature TCYL will improve fuel economy of internal combustion engine 10 and drivability and reduce emissions. On the other hand, during the engine warm-up, performing the cooling control in accordance with the combustion chamber wall temperature TCYL does not ensure increasing the cooling water temperature TW in a responsive manner, since the cooling water temperature TW increases in a less responsive manner than the combustion chamber wall temperature TCYL. In light of this, control device 100 performs the cooling control according to the cooling water temperature TW (first flow rate control) while internal combustion engine 10 is warming up, and switches to the cooling control according to the combustion chamber wall temperature TCYL (second flow rate control) after the completion of engine warm-up. Thereby, control device 100 can increase the cooling water temperature TW in a responsive manner during the engine warmup, and can control the combustion chamber wall temperature TCYL so as to prevent abnormal combustion and improve the accuracy in controlling the ignition timing after the completion of engine warm-up.

Figure 4:
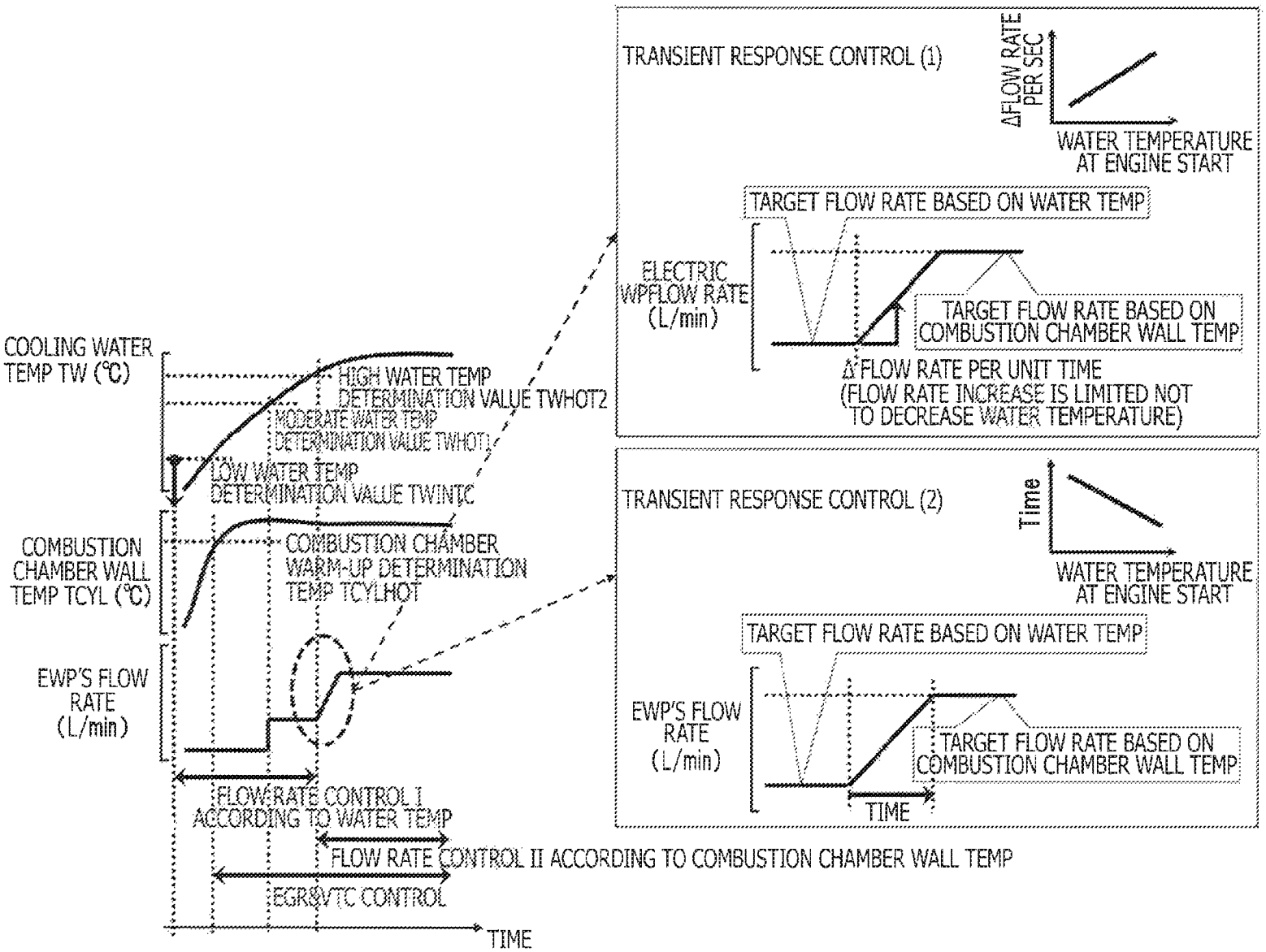
FIG. 4 is a time chart exemplifying the transient response control performed while the flow rate control is switched from one to another according to the embodiment of the present invention.

As described above, during the progression of the warm-up of internal combustion engine 10, control device 100 switches from the state of controlling the flow rate in accordance with the cooling water temperature TW in step S505 (first control state) to the state of controlling the flow rate in accordance with the combustion chamber wall temperature TCYL in step S508 (second control state). At the time of such control switching (in a transient response), control device 100 performs processing for gradually increasing the target discharge flow rate of electric water pump 40 from the target value based on the cooling water temperature TW to the target value based on the combustion chamber wall temperature TCYL, as illustrated in FIG. 4.

In the processing for gradually increasing the target flow rate of electric water pump 40 from the target value based on the cooling water temperature TW to the target value based on the combustion chamber wall temperature TCYL, control device 100 may change the target flow rate either at a predetermined constant speed or at a variable speed set depending on current conditions. For example, control device 100 may reduce the response speed in increasing the target flow rate from the target value based on the cooling water temperature TW to the target value based on the combustion chamber wall temperature TCYL as the engine-start water temperature TWINT is lower.

Here, the overall temperature of internal combustion engine 10 increases more slowly as the engine-start water temperature TWINT is lower. Thus, when the engine-start water temperature TWINT is lower, control device 100 may reduce the response speed in increasing the target flow rate from the target value based on the cooling water temperature TW to the target value based on the combustion chamber wall temperature TCYL (i.e., may slow down the increase of the flow rate). This allows control device 100 to switch to the target flow rate based on the combustion chamber wall temperature TCYL after the warm-up of internal combustion engine 10 has been completed and the overall temperature of internal combustion engine 10 has sufficiently increased. Control device 100 may control the speed of changing the target flow rate as illustrated in FIG. 4. Specifically, control device 100 may determine an amount of change in the flow rate per unit time (Δflow rate/see) is advance, and increase the target flow rate by this predetermined constant amount at the unit time intervals. As an alternative, control device 100 may determine a transient time taken to increase the target flow rate from the target value based on the cooling water temperature TW to the target value based on the combustion chamber wall temperature TCYL, in advance, and increase the target flow rate at a speed calculated based on this predetermined transient time and the difference between the target flow rate based on the cooling water temperature TW to the target flow rate based on the combustion chamber wall temperature TCYL.

Furthermore, as the engine-start water temperature TWINT is lower, control device 100 sets the amount of change in the flow rate per unit time to a lower value, or sets the transient time to a greater value. Thereby, control device 100 reduces the response speed in increasing the target flow rate from the target value based on the cooling water temperature TW to the target value based on the combustion chamber wall temperature TCYL as the engine-start water temperature TWINT is lower. Here, control device 100 starts increasing the target flow rate from the target value based on the cooling water temperature TW to the target value based on the combustion chamber wall temperature TCYL after conditions for switching to the target flow rate based on the combustion chamber wall temperature TCYL are satisfied (after the cooling water temperature TW has increased to the warm-up completion determination temperature). Control device 100 may set a longer delay time from when such switching conditions are satisfied to when control device 100 actually starts increasing the target flow rate to the target value based on the combustion chamber wall temperature TCYL as the engine-start water temperature TWINT is lower. Furthermore, control device 100 may set the warm-up completion determination temperature (the high water temperature determination value TWHOT2) to a higher value as the engine-start water temperature TWINT is lower.

The time charts of FIGS. 5A to 7B exemplify how the cooling water temperature TW ° C.), the combustion chamber wall temperature TCYL (° C.), and the discharge flow rate (L/min) change while control device 100 controls the discharge flow rate of electric water pump 40 according to the flowchart of FIG. 3 in the period from the start to the warm-up completion of internal combustion engine 10.

The time chart of FIG. 5A exemplifies how the cooling water temperature TW and the combustion chamber wall temperature TCYL change after internal combustion engine 10 is startedwhen the cooling water temperature TW is below the low water temperature determination value TWINTC and the combustion chamber wall temperature TCYL is as low as the cooling water temperature TW.

Figure 5A:
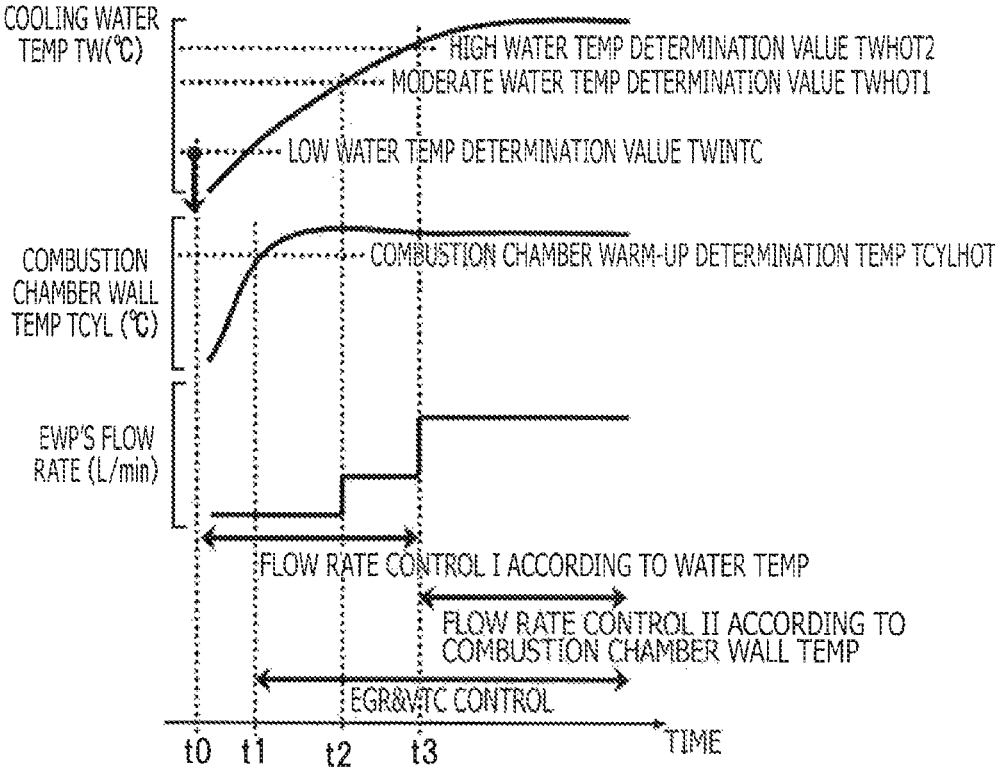
FIG. 5A is a time chart exemplifying how the cooling water temperature TW, the combustion Chamber wall temperature TCYL, and the discharge flow rate change after the internal combustion engine is started when the cooling water temperature TW is below the low water temperature determination value TWINTC and the combustion chamber wall temperature TCYL is as low as the cooling water temperature TW, according to the embodiment of the present invention.

In FIG. 5A, at time point t0, internal combustion engine 10 is started with the cooling water temperature TW being lower than the low water temperature determination value TWINTC. In response, at the same time of this start of internal combustion engine 10, control device 100 starts the cooling control according to the cooling water temperature TW (discharge flow rate control, first control) in step S505 of the flowchart in FIG. 3. Specifically, control device 100 maintains the discharge flow rate of electric water pump 40 at the minimum flow rate until the cooling water temperature TW reaches the moderate water temperature determination value TWHOT1. As a result, the cooling water temperature TW reaches the moderate water temperature determination value TWHOT1 at time point t2. In response, control device 100 increases the discharge flow rate of electric water pump 40 above the minimum flow rate so as to respond to the start of cooling water circulation through the second cooling water line.

After that, control device 100 controls the discharge flow rate of electric water pump 40 in accordance with a change of the cooling water temperature TW (a change of the opening degrees of the second and third cooling water lines) until the cooling water temperature TW reaches the high water temperature determination value (warm-up completion determination temperature) TWHOT2. As a result, the cooling water temperature TW reaches the high water temperature determination value TWHOT2 at time point t3. In response, control device 100 shifts from the flow rate control according to the cooling water temperature TW to the flow rate control according to the combustion chamber wall temperature TCYL.

In the time chart of FIG. 5A, the combustion chamber wall temperature TCYL reaches a temperature that indicates the completion of engine warm-up (combustion chamber warm-up determination temperature TCYLHOT) at time point t1, which is earlier than when the cooling water temperature TW reaches the high water temperature determination value TWHOT2. Nevertheless, control device 100 does not start using the combustion chamber wall temperature TCYL to control the discharge flow rate of electric water pump 40 until the cooling water temperature TW reaches the high water temperature determination value TWHOT2. Thus, even after the combustion chamber wall temperature TCYL reaches combustion chamber warm-up determination temperature TCYLHOT, control device 100 continues the control for accelerating the increase of the cooling water temperature TW. Here, the combustion chamber warm-up determination temperature TCYLHOT is set to approximately 100° C., for example. When internal combustion engine 10 includes an exhaust gas recirculation system and/or a valve timing control system for variably controlling engine valve timing, control device 100 controls the exhaust gas recirculation system in an operating state and/or causes the valve timing control system to change valve timing during a period from time point t1, i.e., after the combustion chamber wall temperature TCYL has increased to the combustion chamber warm-up determination temperature TCYLHOT.

Thus, exhaust gas recirculation is started as soon as the combustion temperature has sufficiently increased, and thus preventing deterioration in the exhaust properties which could otherwise be caused by the increased combustion temperature. Valve timing is changed as soon as the combustion stability has sufficiently increased, and the power output performance of internal combustion engine 10 is improved.

Figure 5B:
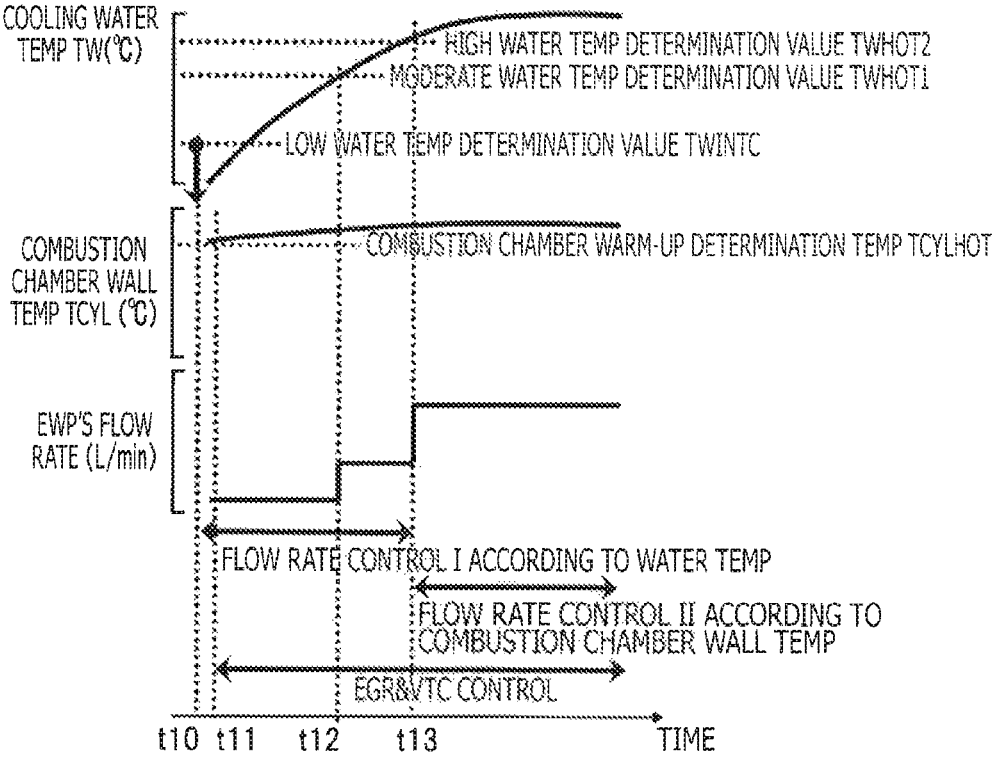
FIG. 5B is a time chart exemplifying how the cooling water temperature TW, the combustion chamber wall temperature TCYL, and the discharge flow rate change after the internal combustion engine is started when the cooling water temperature TW is below the low water temperature determination value TWINTC and the combustion chamber wall temperature TCYL remains as high as the combustion chamber warm-up determination temperature TCYLHOT, according to the embodiment of the present invention.

The time chart of FIG. 5B exemplifies how the cooling water temperature TW, the combustion chamber wall temperature TCYL, and the discharge flow rate change after internal combustion engine 10 is started when the cooling water temperature TW substantially equal to that in the time chart of FIG. 5A and the combustion chamber wall temperature TCYL remains as high as the combustion chamber warm-up determination temperature TCYLHOT.

In the example illustrated in the time chart of FIG. 5B, at the start of internal combustion engine 10, the combustion chamber wall temperature TCYL remains as high as the combustion chamber warm-up determination temperature TCYLHOT, but the cooling water temperature TW is below the low water temperature determination value TWINTC as in the time chart of FIG. 5A. Thus, from time point t10 to time point t13, i.e., until the cooling water temperature TW reaches the high water temperature determination value (warm-up completion determination temperature) TWHOT2, control device 100 performs the flow rate control as in the time chart of FIG. 5A. In other words, the fact that the combustion chamber wall temperature TCYL remains as high as the combustion chamber warm-up determination temperature TCYLHOT when internal combustion engine 10 is started does not affect the control for increasing the cooling water temperature TW to the high water temperature determination value TWHOT2 (engine warm-up control or cooling water temperature control). In the example illustrated in the time chart of FIG. 5B, control device 100 starts to control the exhaust gas recirculation system in an operating state and/or causes the valve timing control system to change valve timing, immediately after internal combustion engine 10 is started (at time point t11), since the combustion chamber wall temperature TCYL remains as high as the combustion chamber warm-up determination temperature TCYLHOT when internal combustion engine 10 is started.

Figure 6A:
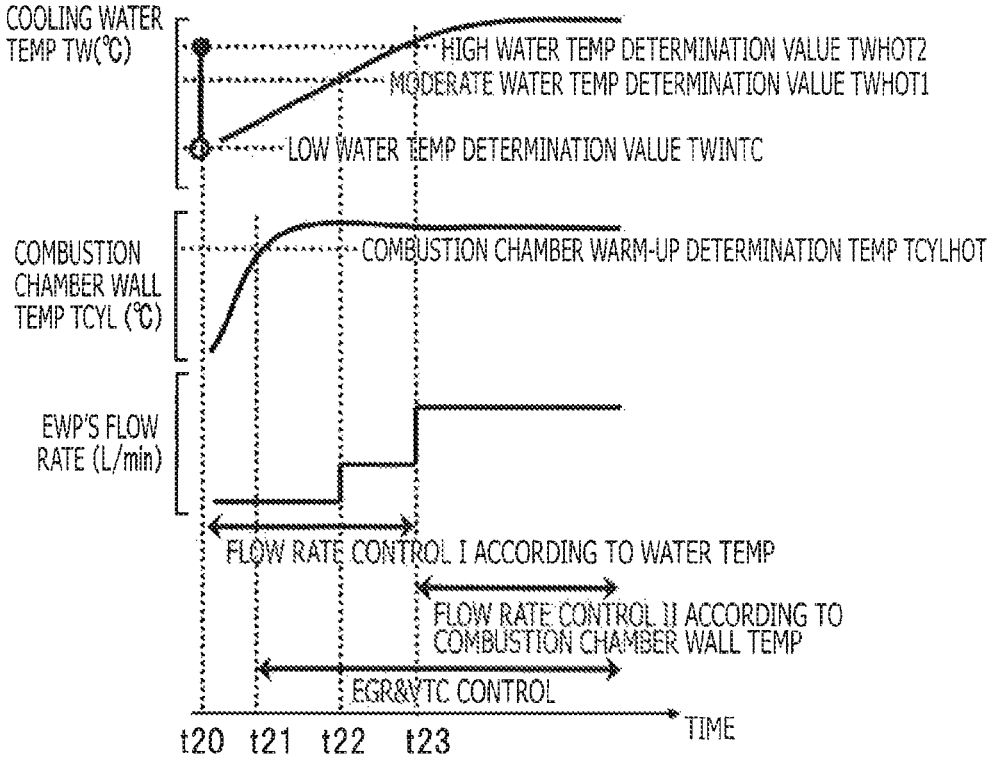
FIG. 6A is a time chart exemplifying how the cooling water temperature TW, the combustion chamber wall temperature TCYL, and the discharge flow rate change after the internal combustion engine is started when the cooling water temperature TW is above the low water temperature determination value TWINTC, according to the embodiment of the present invention.

The time chart of FIG. 6A exemplifies how the cooling water temperature TW, the combustion chamber wall temperature TCYL, and the discharge flow rate change after internal combustion engine 10 is started when the cooling water temperature TW (the engine-start water temperature TWINT) is above the low water temperature determination value TWINTC. Even when the engine-start water temperature TWINT is above the low water temperature determination value TWINTC, control device 100 maintains the discharge flow rate of electric water pump 40 at the minimum flow rate until the cooling water temperature TW reaches the moderate water temperature determination value TWHOT1. As a result, the cooling water temperature TW reaches the moderate water temperature determination value TWHOT1 at time point t22. In response, control device 100 increases the discharge flow rate of electric water pump 40 above the minimum flow rate so as to respond to the start of cooling water circulation through the second cooling water line.

After that, control device 100 controls the discharge flow rate of electric water pump 40 in accordance with a change of the cooling water temperature TW (change of the opening degrees of the second and third cooling water lines) until the cooling water temperature TW reaches the high water temperature determination value (warm-up completion determination temperature) TWHOT2. As a result, the cooling water temperature TW reaches the high water temperature determination value TWHOT2 at time point t23. In response, control device 100 shifts from the flow rate control according to the cooling water temperature TW to the flow rate control according to the combustion chamber wall temperature TCYL.

Figure 6B:
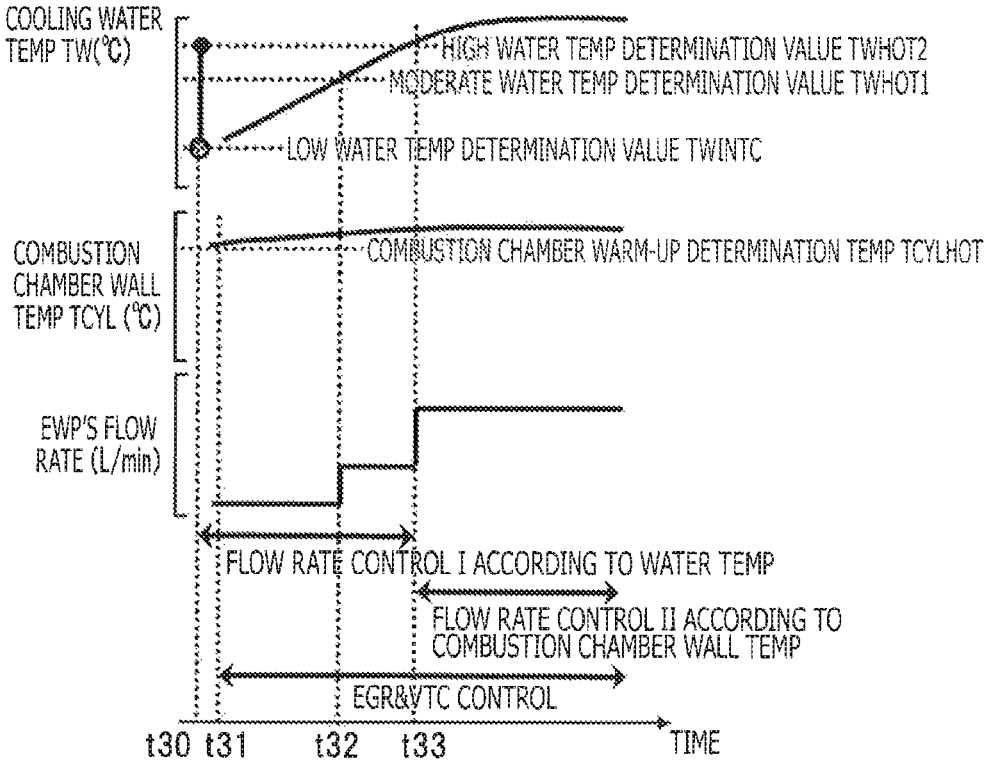
FIG. 6B is a time chart exemplifying how the cooling water temperature TW, the combustion chamber wall temperature TCYL, and the discharge flow rate change after the internal combustion engine is started when the cooling water temperature TW is above the low water temperature determination value TWINTC and the combustion chamber wall temperature TCYL remains as high as the combustion chamber warm-up determination temperature TCYLHOT, according to the embodiment of the present invention.

The time chart of FIG. 6B exemplifies how the cooling water temperature TW, the combustion chamber wall temperature TCYL, and the discharge flow rate change after internal combustion engine 10 is started when the cooling water temperature TW substantially equal to that in the time chart of FIG. 6A and the combustion chamber wall temperature TCYL remains as high as the combustion chamber warm-up determination temperature TCYLHOT.

In the example illustrated in the time chart of FIG. 6B, at the start of internal combustion engine 10, the combustion chamber wall temperature TCYL remains as high as the combustion chamber warm-up determination temperature TCYLHOT, but the cooling water temperature TW is substantially equal to that in the time chart of FIG. 6A. Thus, until time point t23, when the cooling water temperature TW reaches the high water temperature determination value (warm-up completion determination temperature) TWHOT2, control device 100 performs the flow rate control as in the time chart of FIG. 6A. In other words, the fact that the combustion chamber wall temperature TCYL remains as high as the combustion chamber warm-up determination temperature TCYLHOT when internal combustion engine 10 is started does not affect the control for increasing the cooling water temperature TW to the high water temperature determination value TWHOT2 (engine warm-up control or cooling water temperature control).

Here, the combustion chamber wall temperature TCYL already reaches the combustion chamber warm-up determination temperature TCYLHOT at the start of internal combustion engine 10 in the example of FIG. 6B, whereas it does not in the example of FIG. 6A. Accordingly, in the example of FIG. 6B, control device 100 starts to control the exhaust gas recirculation system in an operating state and/or cause the valve timing control system to change valve timing, immediately after internal combustion engine 10 is started. In contrast, in the example of FIG. 6A, control device 100 does the same after the combustion chamber wall temperature TCYL has increased to the combustion chamber warm-up determination temperature TCYLHOT.

Figure 7A:
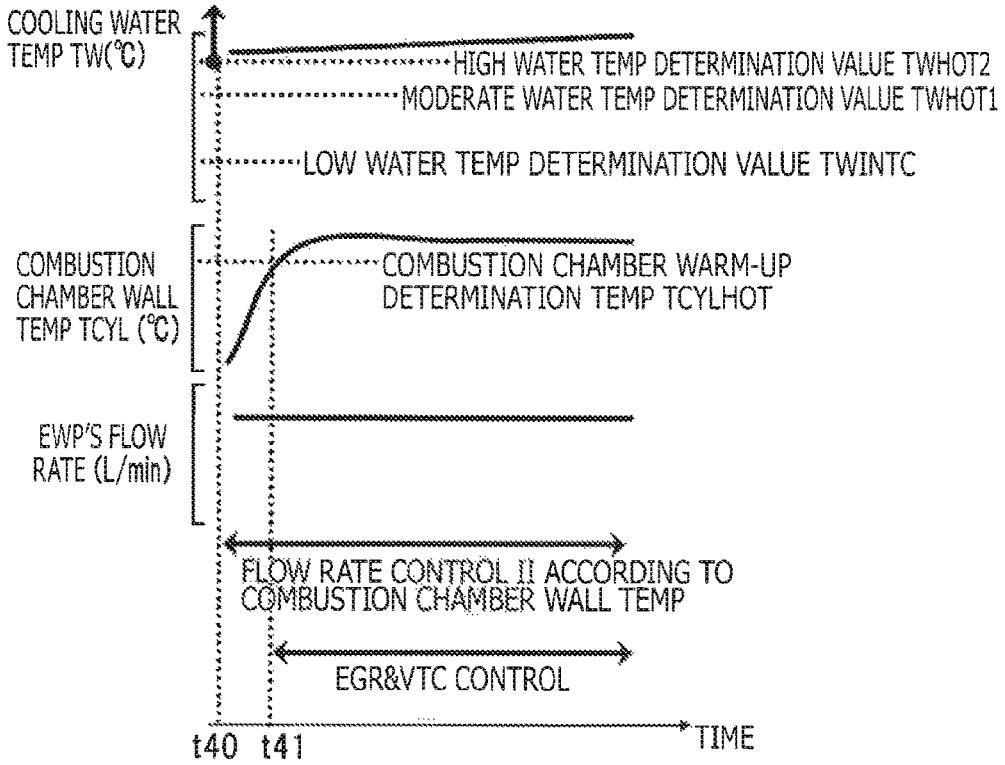
FIG. 7A is a time chart exemplifying how the cooling water temperature TW, the combustion chamber wall temperature TCYL, and the discharge flow rate change after the internal combustion engine is started when the cooling water temperature TW is equal to or above the high water temperature determination value TWHOT2, according to the embodiment of the present invention.

The time chart of FIG. 7A exemplifies how the cooling water temperature TW, the combustion chamber wall temperature TCYL, and the discharge flow rate change after internal combustion engine 10 is started when the cooling water temperature TW (the engine-start water temperature TWINT) is equal to or above the high water temperature determination value TWHOT2. In this case, since the engine-start water temperature TWINT is equal to or above the high water temperature determination value TWHOT2, the engine warm-up operation for further increasing the cooling water temperature TW is not necessary. Accordingly, control device 100 performs the discharge flow rate control according to the combustion chamber wall temperature TCYL (in step S508) as early as the start of internal combustion engine 10.

However, in the example of FIG. 7A, the combustion chamber wall temperature TCYL does not reach the combustion chamber warm-up determination temperature TCYLHOT at the start of internal combustion engine 10 (at time point t40). Accordingly, control device 100 controls the exhaust gas recirculation system (EQR system) in an operating state and/or causes the valve timing control system to change valve timing during a period from time point t41, i.e., after the combustion chamber wall temperature TCYL has increased to the combustion chamber warm-up determination temperature TCYLHOT.

Figure 7B:
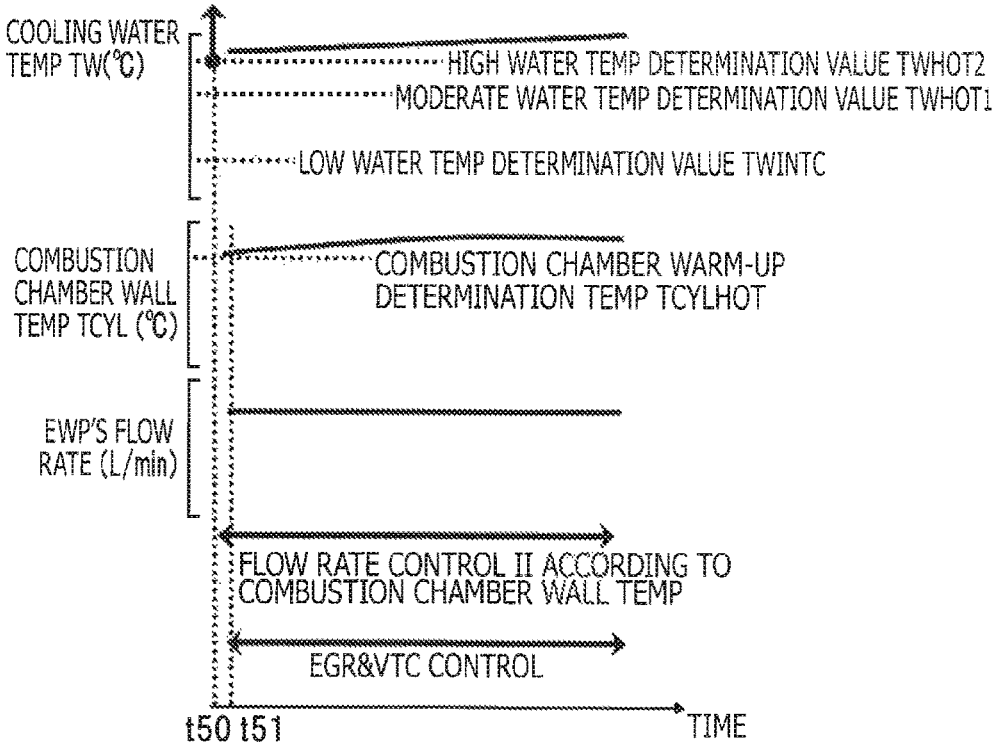
FIG. 7B is a time chart exemplifying how the cooling water temperature TW, the combustion chamber wall temperature TCYL, and the discharge flow rate change after the internal combustion engine is started when the cooling water temperature TW is equal to or above high water temperature determination value TWHOT2 and the combustion chamber wall temperature TCYL remains as high as the combustion chamber warm-up determination temperature TCYLHOT, according to the embodiment of the present invention.

The time chart of FIG. 7B also exemplifies how the cooling water temperature TW, the combustion chamber wall temperature TCYL, and the discharge flow rate change after internal combustion engine 10 is started when the cooling water temperature TW (the engine-start water temperature TWINT) is equal to or above the high water temperature determination value TWHOT2. In contrast to FIG. 7A, however, the combustion chamber wall temperature TCYL remains as high as the combustion chamber warm-up determination temperature TCYLHOT when internal combustion engine 10 is started in the example of FIG. 7B. Accordingly, in the example of FIG. 7B, control device 100 starts to control the discharge flow rate in accordance with the combustion chamber wall temperature TCYL, as well as starts to control the exhaust gas recirculation system in an operating state and/or causes the valve timing control system to change valve timing, immediately after internal combustion engine 10 is started.

Although the invention has been described in detail with reference to the preferred embodiment, it is apparent that the invention may be modified in various ways by one skilled in the art based on the fundamental technical concept and teachings of the invention. Specifically, the device for controlling the discharge flow rate of electric water pump 40 according to the present invention is not limited to the cooling device exemplified in FIG. 1. For example, a cooling water line connecting cylinder block cooling water passage 62 with flow rate control valve 30 may be added in the system configuration of FIG. 1 so as to allow flow rate control valve 30 to control the flow rate of cooling water circulating through cylinder block 12. Furthermore, the above method for controlling the discharge flow rate of electric water pump 40 may also be applied to a cooling device including a thermostat for switching between a circulation path extending through the radiator and a circulation path bypassing the radiator.

Furthermore, control device 100 may control the discharge flow rate of electric water pump 40 in a different manner from the above. Specifically, control device 100 may determine a base flow rate based on the engine rotation speed and engine load in advance, and determine a flow rate correction amount based on the cooling water temperature TW or the combustion chamber wall temperature TCYL. Control device 100 may control the discharge flow rate of electric water pump 40 toward a target flow rate obtained by correcting the base flow rate with the flow rate correction amount.

REFERENCE SYMBOL LIST

10 internal combustion engine
11 cylinder head
12 cylinder block
20 transmission
21 oil warmer and cooler
30 flow rate control valve
32-34 inlet port
35 outlet port
40 electric water pump
50 radiator
61 cylinder head cooling water passage
62 cylinder block cooling water passage
81 water temperature sensor
82 combustion chamber wall temperature sensor

91 heater core
92 EGR cooler
93 EGR control valve
94 throttle valve
95 thermostat
100 control device (pump control means)

The invention claimed is:

1. A cooling device for an internal combustion engine of a vehicle, the cooling device comprising:

an electric water pump configured to circulate cooling water through the internal combustion engine;

a water temperature sensor configured to measure a temperature of the cooling water at a cooling water outlet provided to the internal combustion engine;

a combustion chamber wall temperature sensor disposed on a combustion chamber wall of the internal combustion engine and configured to measure a temperature of the combustion chamber wall; and a processor configured to acquire a signal from the water temperature sensor and a signal from the combustion chamber wall temperature sensor, and to output a control command for controlling a discharge flow rate of the electric water pump, wherein the processor performs first pump control of increasing the discharge flow rate of the electric water pump in accordance with an increase of the temperature of the cooling water measured by the water temperature sensor, when the temperature of the cooling water measured by the water temperature sensor is below a warm-up completion determination temperature, the processor shifts from the first pump control to second pump control of controlling the discharge flow rate of the electric water pump by comparing the temperature of the combustion chamber wall measured by the combustion chamber wall temperature sensor with a target temperature so as to bring the temperature of the combustion chamber wall toward the target temperature, when the temperature of the cooling water measured by the water temperature sensor is above the warm-up completion determination temperature, and the processor changes the target temperature of the combustion chamber wall in the second pump control in accordance with the temperature of the cooling water measured by the water temperature sensor.

2. The cooling device for the internal combustion engine of the vehicle according to claim 1, wherein the processor sets the target temperature to be equal to the temperature of the cooling water measured by the water temperature sensor.

3. The cooling device for the internal combustion engine of the vehicle according to claim 1, wherein, when the processor shifts from the first pump control to the second pump control, the processor reduces a response speed in changing the discharge flow rate of the electric water pump from a discharge flow rate adapted for the first pump control to a discharge flow rate adapted for the second pump control as the temperature of the cooling water measured by the water temperature sensor at start of the internal combustion engine is lower.

4. The cooling device for the internal combustion engine of the vehicle according to claim 1, wherein, while the internal combustion engine is in an idle reduction state after the temperature of the cooling water measured by the water temperature sensor exceeds the warm-up completion determination temperature, the processor controls the discharge flow rate of the electric water pump by comparing the temperature of the combustion chamber wall measured by the combustion chamber wall temperature sensor with a target temperature for the idle reduction state so as to bring the temperature of the combustion chamber wall toward the target temperature for the idle reduction state.

5. A method for controlling a cooling device for an internal combustion engine of a vehicle, the cooling device including an electric water pump for circulating cooling water through the internal combustion engine of the vehicle, the control method comprising:

acquiring a signal related to a temperature of the cooling water from a water temperature sensor configured to measure a temperature of the cooling water at a cooling water outlet provided to the internal combustion engine;

acquiring a signal related to a temperature of a combustion chamber wall of the internal combustion engine from the combustion chamber wall temperature sensor disposed on the combustion chamber wall and configured to measure the temperature of the combustion chamber wall;

comparing the temperature of the cooling water measured by the water temperature sensor with a warm-up completion determination temperature;

performing first pump control of increasing a discharge flow rate of the electric water pump in accordance with an increase of the temperature of the cooling water measured by the water temperature sensor, when the temperature of the cooling water measured by the water temperature sensor is below the warm-up completion determination temperature;

shifting from the first pump control to second pump control of controlling the discharge flow rate of the electric water pump by comparing the temperature of the combustion chamber wall measured by the combustion chamber wall temperature sensor with a target temperature so as to bring the temperature of the combustion chamber wall toward the target temperature, when the temperature of the cooling water measured by the water temperature sensor is above the warm-up completion determination temperature, and changing the target temperature of the combustion chamber wall in the second pump control in accordance with the temperature of the cooling water measured by the water temperature sensor.

* * * * *